US009487366B2

(12) United States Patent
Yamaguchi

(10) Patent No.: US 9,487,366 B2
(45) Date of Patent: Nov. 8, 2016

(54) BELT CONVEYING DEVICE PROVIDED WITH ROTATABLE ASSEMBLY AND FRAME FOR SKEW CORRECTION OF BELT

(71) Applicant: Brother Kogyo Kabushiki Kaisha, Nagoya (JP)

(72) Inventor: Wataru Yamaguchi, Nisshin (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/635,181

(22) Filed: Mar. 2, 2015

(65) Prior Publication Data

US 2015/0274457 A1 Oct. 1, 2015

(30) Foreign Application Priority Data

Mar. 28, 2014 (JP) ..... 2014-067368

(51) Int. Cl.
*B65G 39/16* (2006.01)
*B65H 5/02* (2006.01)
*B65H 20/06* (2006.01)

(52) U.S. Cl.
CPC ..... *B65H 5/021* (2013.01); *B65H 20/06* (2013.01); *B65H 2403/41* (2013.01); *B65H 2404/255* (2013.01); *B65H 2404/256* (2013.01); *B65H 2404/261* (2013.01); *B65H 2601/272* (2013.01); *B65H 2801/06* (2013.01)

(58) Field of Classification Search
CPC ... B65G 39/16; B65G 15/64; G03G 15/6567
USPC ..... 198/860, 807, 810.03
See application file for complete search history.

(56) References Cited

U.S. PATENT DOCUMENTS

| | | | | |
|---|---|---|---|---|
| 3,715,027 | A * | 2/1973 | Fujimoto | B65G 39/16 101/122 |
| 5,960,936 | A * | 10/1999 | Kuehnle | B41F 21/005 198/807 |
| 6,786,325 | B2 * | 9/2004 | Powell | B65G 39/16 198/806 |
| 7,806,253 | B2 * | 10/2010 | Graswinckel | G03G 15/755 198/806 |
| 8,086,156 | B2 * | 12/2011 | Tao | G03G 15/0131 198/806 |
| 9,212,004 | B2 | 12/2015 | Kawanami et al. | |
| 2002/0046932 | A1 | 4/2002 | Wakana | |
| 2009/0087231 | A1 | 4/2009 | Masaki et al. | |
| 2009/0245899 | A1 | 10/2009 | Sato | |
| 2014/0144759 | A1 | 5/2014 | Kawanami et al. | |
| 2015/0329292 | A1 | 11/2015 | Kawanami et al. | |

FOREIGN PATENT DOCUMENTS

| | | |
|---|---|---|
| JP | 2002-23518 A | 1/2002 |
| JP | 2009-86463 A | 4/2009 |
| JP | 2009-237189 A | 10/2009 |

* cited by examiner

*Primary Examiner* — James R Bidwell
(74) *Attorney, Agent, or Firm* — Burr & Brown, PLLC

(57) ABSTRACT

A belt conveying device includes: a first roller, a second roller, a belt, a rotatable assembly, and a frame. The first roller has an axis extending in an axial direction. The first roller has a first end portion on a first side in the axial direction and a second end portion on a second side opposite to the first side in the axial direction. The belt is configured to be looped taut around the first roller and the second roller. The rotatable assembly has a first gear and is provided at the first end portion. The rotatable assembly is configured to provide a first position to engage with the first roller and to rotate and a second position to be disengaged from the first roller. The frame has a second gear arranged in a prescribed direction. The second gear engages with the first gear.

20 Claims, 12 Drawing Sheets

BELT CONVEYING DEVICE PROVIDED WITH ROTATABLE ASSEMBLY AND FRAME FOR SKEW CORRECTION OF BELT

CROSS REFERENCE TO RELATED APPLICATION

This application claims priority from Japanese Patent Application No. 2014-067368 filed Mar. 28, 2014. The entire content of the priority application is incorporated herein by reference.

TECHNICAL FIELD

The present disclosure relates to a belt conveying device that conveys a recording medium by using a belt stretched around a plurality of rollers and also relates to an image forming apparatus including the same. More specifically, the present disclosure relates to a technique of reducing the skewness of a belt.

BACKGROUND

Hitherto, a belt conveying device that conveys a recording medium such as a sheet by using a belt stretched around a plurality of rollers has been practically used. In such a belt conveying device, there is known a problem in which, during circulation movement of the belt, the belt skews in a widthwise direction of the belt due to an external force applied from a photosensitive member, a change in temperature, and a variation in component accuracy.

To regulate the above-described skewness, in a belt-type fixing device that transmits heat to a recording medium by a fixing belt stretched around a fixing roller and a heating roller, a guide ring that regulates the skewness of the fixing belt is provided at at least one axial end of the rollers. The tensile force of the fixing belt is adjusted by moving the heating roller so that the distance between the heating roller and the fixing roller is shortened in response to an increase in the temperature of the heating roller, and the guide ring is separated from the fixing belt so as to prevent the damage in the fixing belt.

SUMMARY

However, the above-described belt-type fixing device has the following problems. That is, since the skew occurred in the fixing belt is caused not only by a change in temperature but also by various factors, the tensile force of the fixing belt needs to be adjusted in consideration of various factors. However, it is difficult to adjust the tensile force of the fixing belt by controlling various factors. For this reason, another type of skew regulating member has been demanded.

In view of the foregoing, it is an object of the disclosure to provide a belt conveying device that conveys a sheet by a belt and that is capable of regulating the skewness of the belt.

In order to attain the above and other objects, according to one aspect, the disclosure provides a belt conveying device including: a first roller; a second roller; a belt; a rotatable assembly; and a frame. The first roller has an axis extending in an axial direction. The first roller has a first end portion on a first side in the axial direction and a second end portion on a second side opposite to the first side in the axial direction. The belt is configured to be looped taut around the first roller and the second roller. The rotatable assembly has a first gear and is provided at the first end portion. The rotatable assembly is configured to provide a first position to engage with the first roller and to rotate and a second position to be disengaged from the first roller. The frame has a second gear arranged in a prescribed direction. The second gear engages with the first gear.

According to another aspect, the disclosure provides an image forming apparatus including: a first roller; a second roller; a belt; an image forming unit; a rotatable assembly; and a frame. The first roller has an axis extending in an axial direction. The first roller has a first end portion on a first side in the axial direction and a second end portion on a second side opposite to the first side in the axial direction. The belt is configured to be looped taut around the first roller and the second roller. The image forming unit is configured to from an image on a sheet conveyed by the belt. The rotatable assembly has a first gear and is provided at the first end portion. The rotatable assembly is configured to provide a first position to engage with the first roller and to rotate and a second position to be disengaged from the first roller. The frame has a second gear arranged in a prescribed direction. The second gear engages with the first gear.

According to still another aspect, the disclosure provides a belt conveying device including: a first roller; a second roller; a belt; a flange portion; a gear portion; and a frame. The first roller has an axis extending in an axial direction. The first roller has a first end on a first side in the axial direction and a second end on a second side opposite to the first side in the axial direction. The belt is configured to be looped taut around the first roller and the second roller. The flange portion has a portion that has an outer diameter larger than that of the first roller. The flange portion is configured to be movable along with the belt in the axial direction. The gear portion has a first gear and is provided at a position next to the flange portion toward the first side. The frame has a second gear arranged in a prescribed direction. The second gear engages with the first gear.

BRIEF DESCRIPTION OF THE DRAWINGS

The particular features and advantages of an aspect of this disclosure as well as other objects will become apparent from the following description taken in connection with the accompanying drawings, in which.

DETAILED DESCRIPTION

Figure 1:
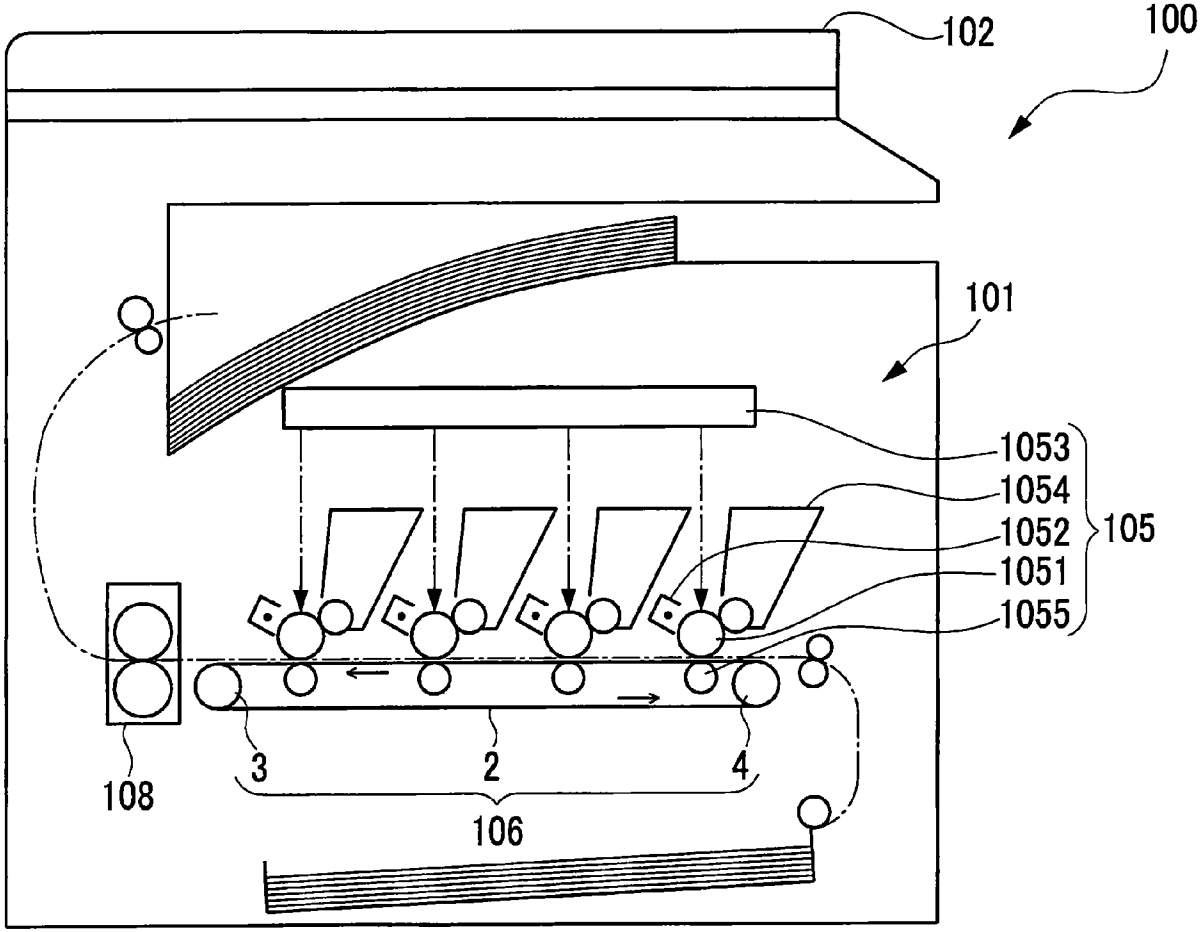
FIG. 1 is a cross-sectional view showing a general structure of a multi-function peripheral (MFP) in which skew correction assemblies according to first through fifth embodiments are provided.

A multi-function peripheral (hereinafter referred to as MFP) 100 as an example of an image forming apparatus in which skew correction assemblies according to first through fifth embodiments are provided will be described with reference to FIG. 1. Next, the skew correction assemblies according to first through fifth embodiments will be described in detail while referring to FIGS. 2 through 12, wherein like parts and components are designated by the same reference numerals to avoid duplicating description.

The MFP 100 has an image forming function. As illustrated in FIG. 1, the MFP 100 includes an image forming unit 101 that forms an image on a sheet, and an image reading unit 102 that reads an image of an original document. The image reading unit 102 includes an image sensor, and reads an image of an original document while relatively moving the original document and the image sensor. The image forming unit 101 includes a process unit 105 that forms a toner image by an electrophotographic method, a belt conveying device 106 that includes a conveyor belt 2, a drive roller 3 and a driven roller 4 and that conveys a sheet toward the process unit 105 through the conveyor belt 2, and a fixing unit 108 that fixes a toner image onto a sheet.

The process unit 105 of the image forming unit 101 has the same configuration for each of four colors, that is, yellow, magenta, cyan, and black, and the process units 105 for the respective colors are arranged in juxtaposition with each other along the conveyor belt 2. The process unit 105 for each color includes a photosensitive member 1051, a charging unit 1052, a developing unit 1054, and a transfer unit 1055. A common exposure unit 1053 is provided above the process units 105 for all colors. Note that the exposure unit 1053 is also a part of the process unit 105. Furthermore, the arrangement or the order of the process units 105 for respective colors may be arbitrarily set.

In an image forming operation, the charging unit 1052 charges a surface of the photosensitive member 1051, and then the exposure unit 1053 exposes the surface of the photosensitive member 1051 to light. Accordingly, an electrostatic latent image is formed on the surface of the photosensitive member 1051 based on image data. Further, a toner is supplied from the developing unit 1054 to the electrostatic latent image formed on the surface of the photosensitive member 1051, so that a toner image is formed on the surface of the photosensitive member 1051.

The conveyor belt 2 as an example of a belt is an endless belt that is moved by the drive roller 3 and the driven roller 4. The conveyor belt 2 circulates in the counter-clockwise direction in FIG. 1 so as to convey a sheet from the process unit 105 toward the fixing unit 108. When an image is formed on a sheet, a toner image formed on the photosensitive member 1051 is transferred onto the sheet by the transfer unit 1055. Subsequently, the toner image carried on the sheet is fixed onto the sheet by the fixing unit 108.

Figure 2:
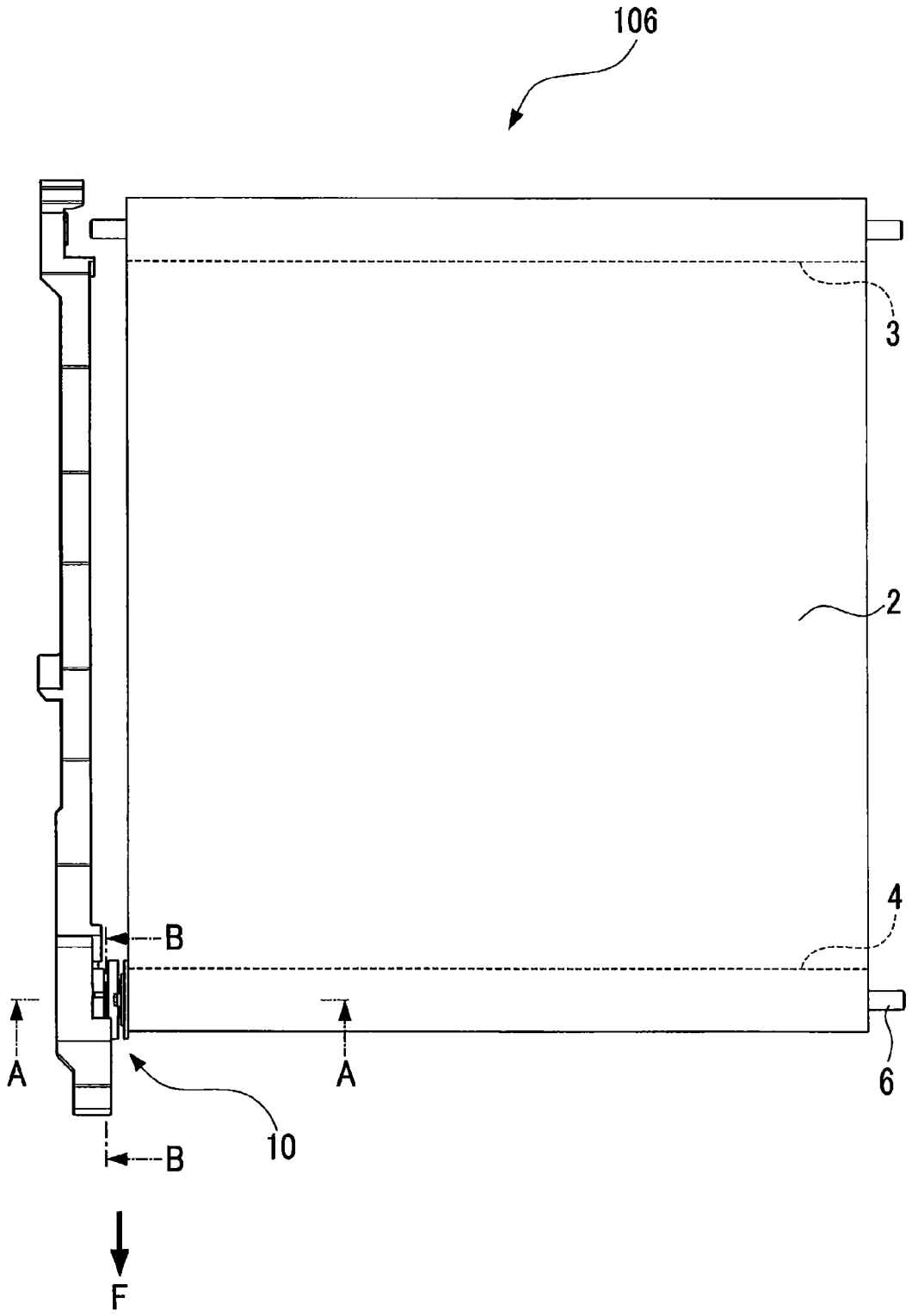
FIG. 2 is a plan view showing an external appearance of a belt conveying device provided in the MFP in FIG. 1, in which a skew correction assembly according to the first embodiment and a conveyor belt are provided.

As illustrated in FIG. 2, the drive roller 3 as an example of a second roller and the driven roller 4 as an example of a first roller are disposed in parallel with each other, and the conveyor belt 2 is looped taut around the drive roller 3 and the driven roller 4 by a predetermined tensile force. The conveyor belt 2 is a resinous belt that is formed in an endless state with a substantially uniform thickness. The drive roller 3 is supported to a housing (not illustrated) through roller shafts provided at both ends of the drive roller 3 in an axial direction thereof. The drive roller 3 is rotationally driven by a motor (not illustrated) to circularly move the conveyor belt 2 in one direction.

Figure 3:
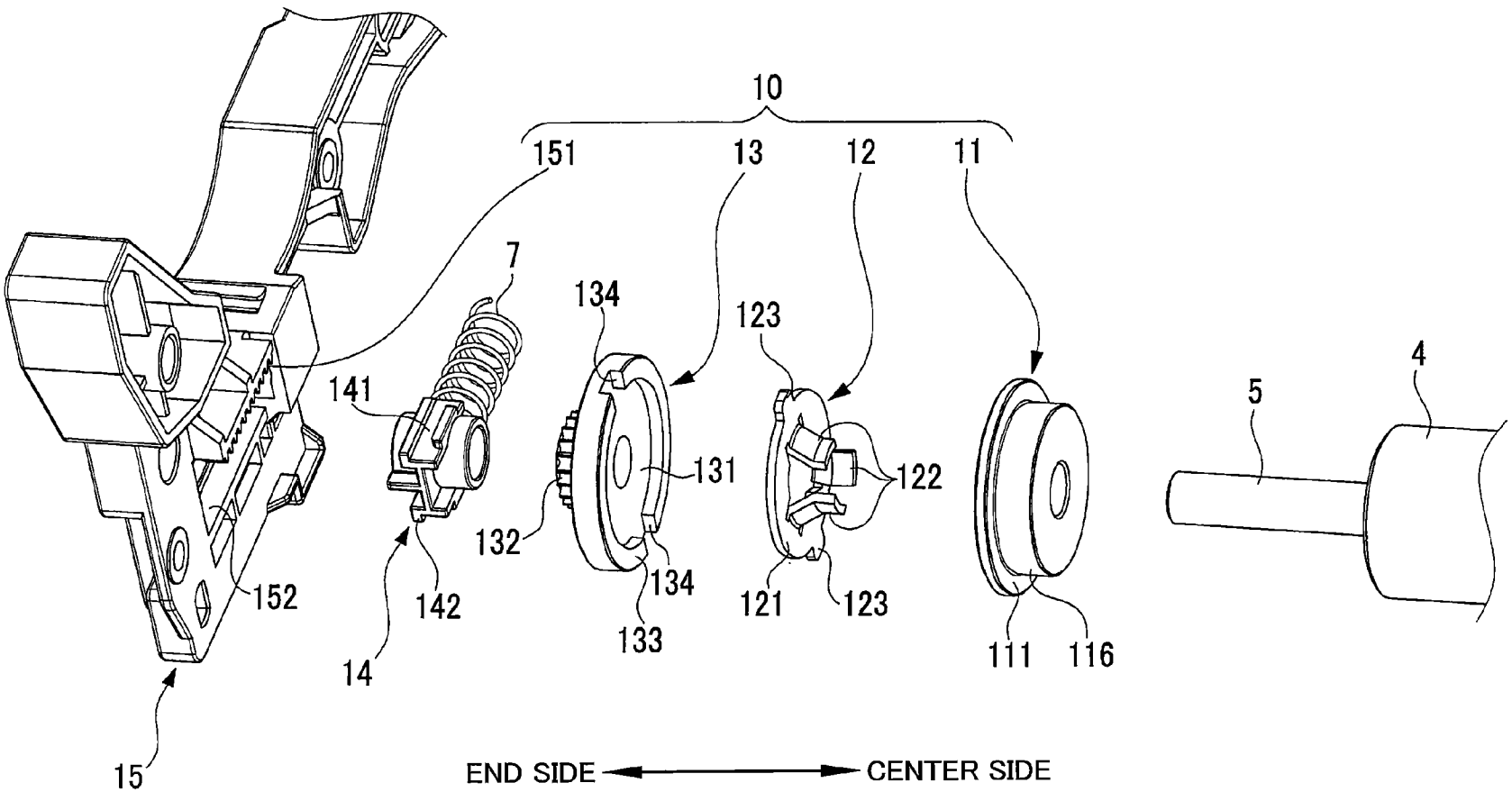
FIG. 3 is an exploded perspective view of the skew correction assembly according to the first embodiment.

Further, roller shafts 5 and 6 are provided at both ends of the driven roller 4 in an axial direction thereof so as not to rotate relative to the driven roller 4 (see also FIG. 3). The roller shafts 5 and 6 extend from a roller body of the driven roller 4 in the axial direction. The roller shaft 5 is disposed at the axial end at the end side of the driven roller 4, while the roller shaft 6 is disposed at the axial end at the center side of the driven roller 4. The roller shafts 5 and 6 each have an outer diameter smaller than an outer diameter of the roller body of the driven roller 4. The roller shaft 5 is an example of a rotation shaft. The driven roller 4 rotates so as to follow the circulation movement of the conveyor belt 2 by a friction force generated between the conveyor belt 2 and the driven roller 4. As will be described below, the driven roller 4 is biased in a direction away from the drive roller 3 by a spring 7 (see FIG. 5), and a tensile force is applied to the conveyor belt 2 by a biasing force of the spring 7. Further, the width of the conveyor belt 2 in a direction perpendicular to the circulating direction of the conveyor belt 2 is substantially equal to the length of the drive roller 3 in its axial direction and to the length of the driven roller 4 in its axial direction. For this reason, in FIG. 2, the drive roller 3 and the driven roller 4 are behind and hidden by the conveyor belt 2.

In such a configuration, there is a case where the conveyor belt 2 may skew due to an external force applied from the photosensitive members 1051, a change in temperature, or a variation in component accuracy when the conveyor belt 2 is circularly moved by the drive roller 3. For example, there is a case where a portion of the conveyor belt 2 wound on the driven roller 4 is displaced from a position shown in FIG. 2 in the axial direction of the driven roller 4. In order to correct such displacement of the conveyor belt 2, the MFP 100 includes a skew correction assembly. That is, the skew correction assembly is adapted to correct the skewness of the conveyor belt 2.

Hereinafter, skew correction assemblies 10, 20, 30, 40, and 50 according to first through fifth embodiments will be described in detail. As in the skew correction assembly 10 illustrated in FIG. 2, each of the skew correction assemblies 10, 20, 30, 40, and 50 is disposed at one axial end of the driven roller 4. In other words, in the first through fifth embodiments, each of the skew correction assemblies 10, 20, 30, 40, and 50 are attached to the roller shaft 5. More specifically, each of the skew correction assemblies 10, 20, 30, 40, and 50 is provided at a position further outward than the passage position (circulating position) of the conveyor belt 2 in the axial direction of the driven roller 4. Hereinafter, with respect to the axial direction of the driven roller 4, one side where each of the skew correction assemblies 10, 20, 30, 40, and 50 is disposed will be referred to as the "end side", while the other side will be referred to as the "center side".

In any embodiment, when a portion of the conveyor belt 2 wound on the driven roller 4 is displaced in a direction toward the skew correction assemblies 10, 20, 30, 40, and 50 due to the skew of the conveyor belt 2, an edge of the conveyor belt 2 applies a pressure to each of the skew correction assemblies 10, 20, 30, 40, and 50. When each of the skew correction assemblies 10, 20, 30, 40, and 50 receives the pressure by the edge of the conveyor belt 2, the roller shaft 5 to which each of the skew correction assemblies 10, 20, 30, 40, and 50 is attached is moved (displaced). Hereinafter, a state where each of the skew correction assemblies 10, 20, 30, 40, and 50 is pressed by the edge of the conveyor belt 2 will be referred to as a "pressed state", and a state where each of the skew correction assemblies 10, 20, 30, 40, and 50 is not pressed by the edge of the conveyor belt 2 will be referred to as a "non-pressed state".

Furthermore, the moving direction (displaced direction) of the roller shaft 5 in the first through fourth embodiments is different from that in the fifth embodiment. For example, as indicated by an arrow F in FIG. 2, the moving direction of the roller shaft 5 according to the first through fourth embodiments is a direction in which the roller shaft 5 moves away from the drive roller 3. By this movement, the tensile force at the end side of the conveyor belt 2 increases. Accordingly, the conveyor belt 2 is moved in a direction away from each of the skew correction assemblies 10, 20, 30, and 40 along the driven roller 4, and hence the skewness of the conveyor belt 2 is corrected. Meanwhile, according to the fifth embodiment, the moving direction of the roller shaft 5 is a direction perpendicular to a plane including an axis of the drive roller 3 and an axis of the driven roller 4, as indicated by an arrow G in FIG. 12.

Next, the skew correction assembly 10 according to the first embodiment will be described while referring to FIGS. 3 through 6.

As illustrated in FIG. 3, the skew correction assembly 10 includes a flange member 11, a ring member 12, and a pinion gear member 13. The flange member 11, the ring member 12, and the pinion gear member 13 are attached to the roller shaft 5 provided at the end side of the driven roller 4 in this order from the center side toward the end side. The roller shaft 5 is supported to a bearing 14 (described later) at its end at the end side while extending through the skew correction assembly 10. Further, the bearing 14 is fitted in a frame 15 (described later). The frame 15 is provided with a rack gear 151 (described later). The rack gear 151 constitutes a part of the skew correction assembly 10.

Figure 4:
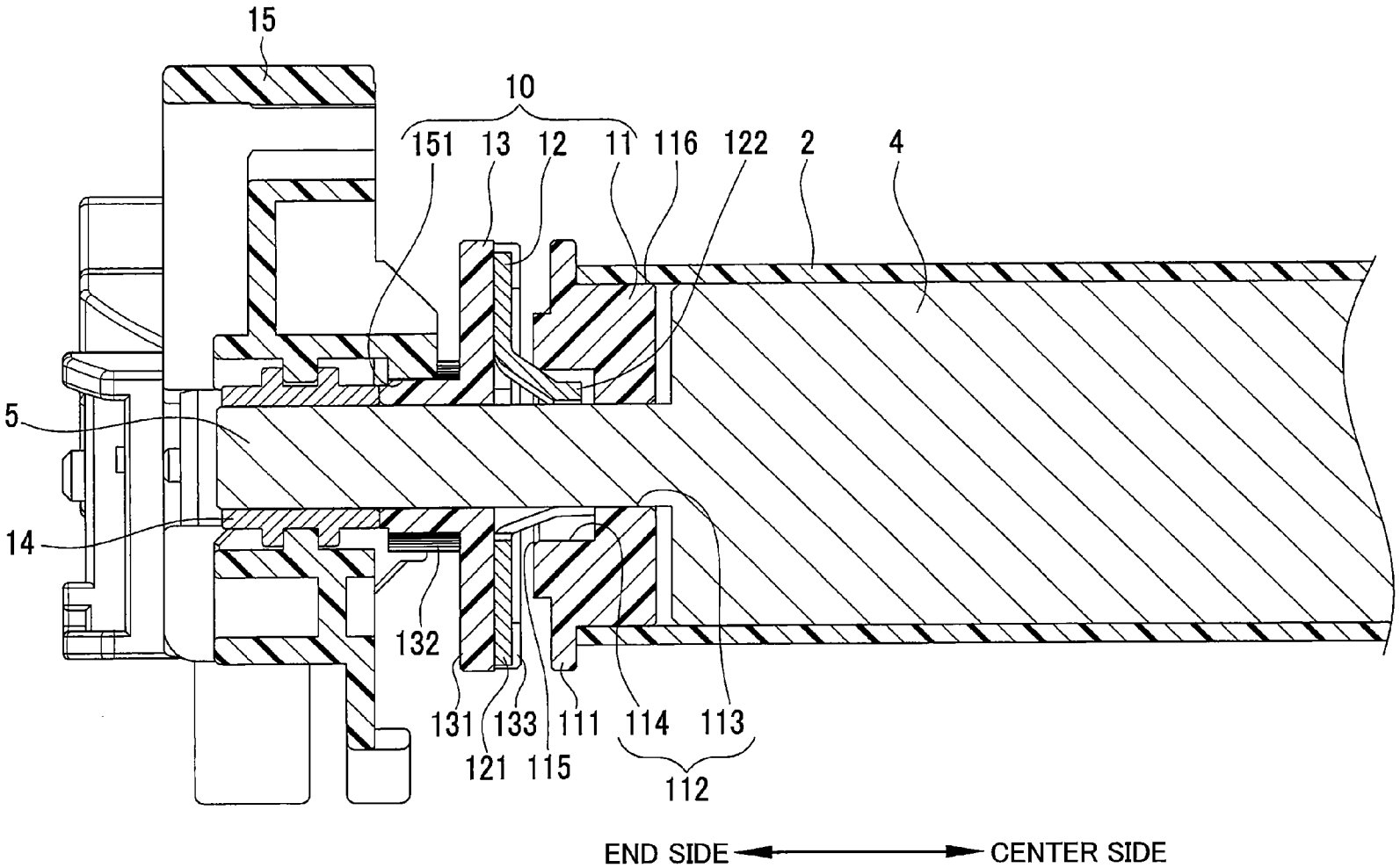
FIG. 4 is a cross-sectional view of the skew correction assembly according to the first embodiment taken along a line A-A shown in FIG. 2, in which the skew correction assembly is in a pressed state.

As illustrated in FIGS. 3 and 4, the flange member 11 is a resinous member and is substantially formed in a cylindrical shape. The flange member 11 includes a flange portion 111. The flange portion 111 is a portion of the flange member 11 having a large-diameter and formed in an outer peripheral surface of the flange member 11. The flange portion 111 has an outer diameter larger than that of the driven roller 4. A difference between the outer diameter of the flange portion 111 and the outer diameter of the driven roller 4 is larger than the thickness of the conveyor belt 2. That is, the edge of the conveyor belt 2 cannot move toward the end side past the flange portion 111.

Further, as illustrated in FIG. 4, the flange member 11 has a stepped through-hole 112. The through-hole 112 has a small-diameter hole portion 113 at the center side thereof and a large-diameter hole portion 114 at the end side thereof. Further, the edge at the end side of the through-hole 112 has a tapered portion 115 whose diameter grows larger toward the end side. The through-hole 112 has a diameter larger than the outer diameter of the roller shaft 5. That is, both an inner diameter of the small-diameter hole portion 113 and an inner diameter of the large-diameter hole portion 114 are larger than the outer diameter of the roller shaft 5.

Figure 6:
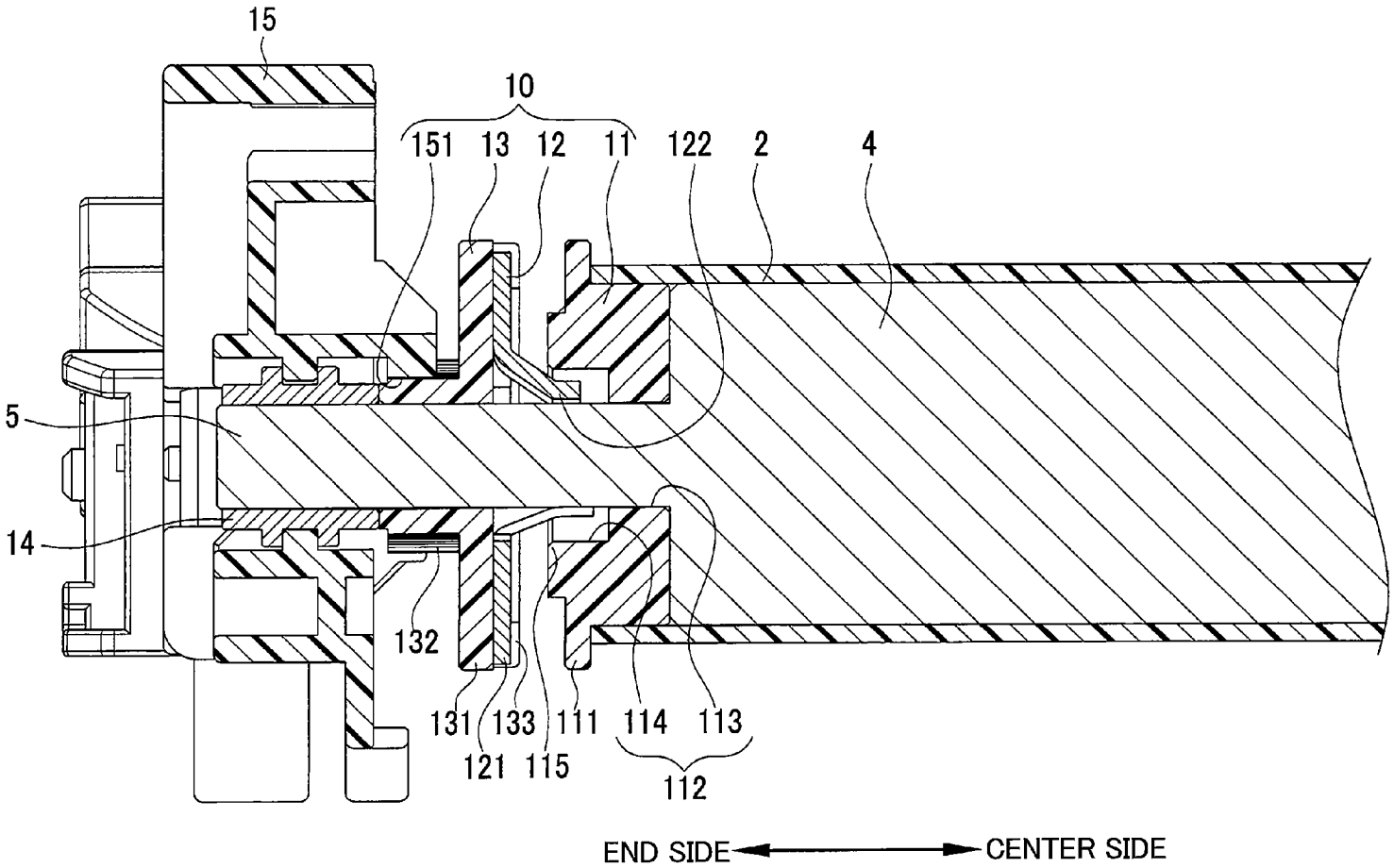
FIG. 6 is a cross-sectional view of the skew correction assembly according to the first embodiment taken along the line A-A shown in FIG. 2, in which the skew correction assembly is in a non-pressed state.

Further, the outer peripheral surface of the flange member 11 has a cylindrical surface 116 at a position toward the center side from the flange portion 111. The cylindrical surface 116 has an outer diameter smaller than the outer diameter of the flange portion 111 and equal to or slightly smaller than the outer diameter of the driven roller 4. As illustrated in FIGS. 4 and 6, the conveyor belt 2 can be wound on the cylindrical surface 116. Note that, in the non-pressed state, the conveyor belt 2 may not be wound on the cylindrical surface 116.

As illustrated in FIGS. 3 and 4, the ring member 12 is a metal-plate member, and includes an annular-shaped ring portion 121 and three movable pieces 122. The movable pieces 122 extend from an inner peripheral portion of the ring portion 121 toward the center side. The movable pieces 122 are disposed in a circumferential direction of the ring portion 121 at the same interval. Further, the movable pieces 122 are inclined inward in a radial direction of the ring portion 121 toward the center side. That is, the movable pieces 122 are inclined so as to be close to each other toward their free end portions. Further, the free end portion of each movable piece 122 has an inner surface that is formed in a curved shape in conformance with a curved shape of an outer peripheral surface of the roller shaft 5.

In the non-pressed state illustrated in FIG. 6, a diameter of an internal space surrounded by the free end portions of the three movable pieces 122 is larger than the outer diameter of the roller shaft 5. Further, a center hole in the ring portion 121 has a diameter larger than the outer diameter of the roller shaft 5. Accordingly, in the non-pressed state, the ring member 12 does not interfere with the rotation of the driven roller 4. Further, the ring member 12 is provided with two convex portions 123 that protrude radially outward on an outer peripheral surface of the ring portion 121.

In a state where the flange member 11 and the ring member 12 are assembled to provide the skew correction assembly 10, the free end portions of the movable pieces 122 are inserted into the large-diameter hole portion 114 of the flange member 11 as illustrated in FIG. 4. In the non-pressed state, the movable pieces 122 and the tapered portion 115 of the flange member 11 may or may not contact each other. Furthermore, the movable piece 122 is formed of metal, and a base end portion thereof has resiliency with respect to bending. When a part of the movable piece 122 is pressed, the movable piece 122 can be deformed such that the free end portion thereof moves in a direction toward the free end portions of the remaining two movable pieces 122. That is, the diameter of the internal space surrounded by the free end portions of the movable pieces 122 in the pressed state is smaller than the diameter in the non-pressed state.

As illustrated in FIGS. 3 and 4, the pinion gear member 13 is a resinous member in which a receiving portion 131 and a pinion gear 132 are integrally provided. The receiving portion 131 is positioned at the center side of the pinion gear member 13 and includes an outer wall 133. The outer wall 133 is formed in an annular shape and protrudes toward the center side along an outer periphery of the receiving portion 131. The outer wall 133 is provided with two notches 134. Further, the pinion gear 132 is positioned at the end side of the pinion gear member 13. The pinion gear 132 has an outer diameter smaller than the outer diameter of the driven roller 4 and larger than the outer diameter of the roller shaft 5.

In a state where the pinion gear member 13 is assembled to the ring member 12 to provide the skew correction assembly 10, the ring portion 121 of the ring member 12 is fitted with the receiving portion 131 of the pinion gear member 13 as illustrated in FIG. 4. At this time, the convex portions 123 of the ring member 12 engage with the notches 134 of the outer wall 133. Hence, the pinion gear member 13 and the ring member 12 do not rotate relatively. That is, when one of the pinion gear member 13 and the ring member 12 rotates, the pinion gear member 13 and the ring member 12 rotate together. Incidentally, in a state where the pinion gear member 13 is assembled to the ring member 12, a surface at the center side of the receiving portion 131 of the pinion gear member 13 and a surface at the end side of the ring portion 121 of the ring member 12 may or may not contact each other.

Figure 5:
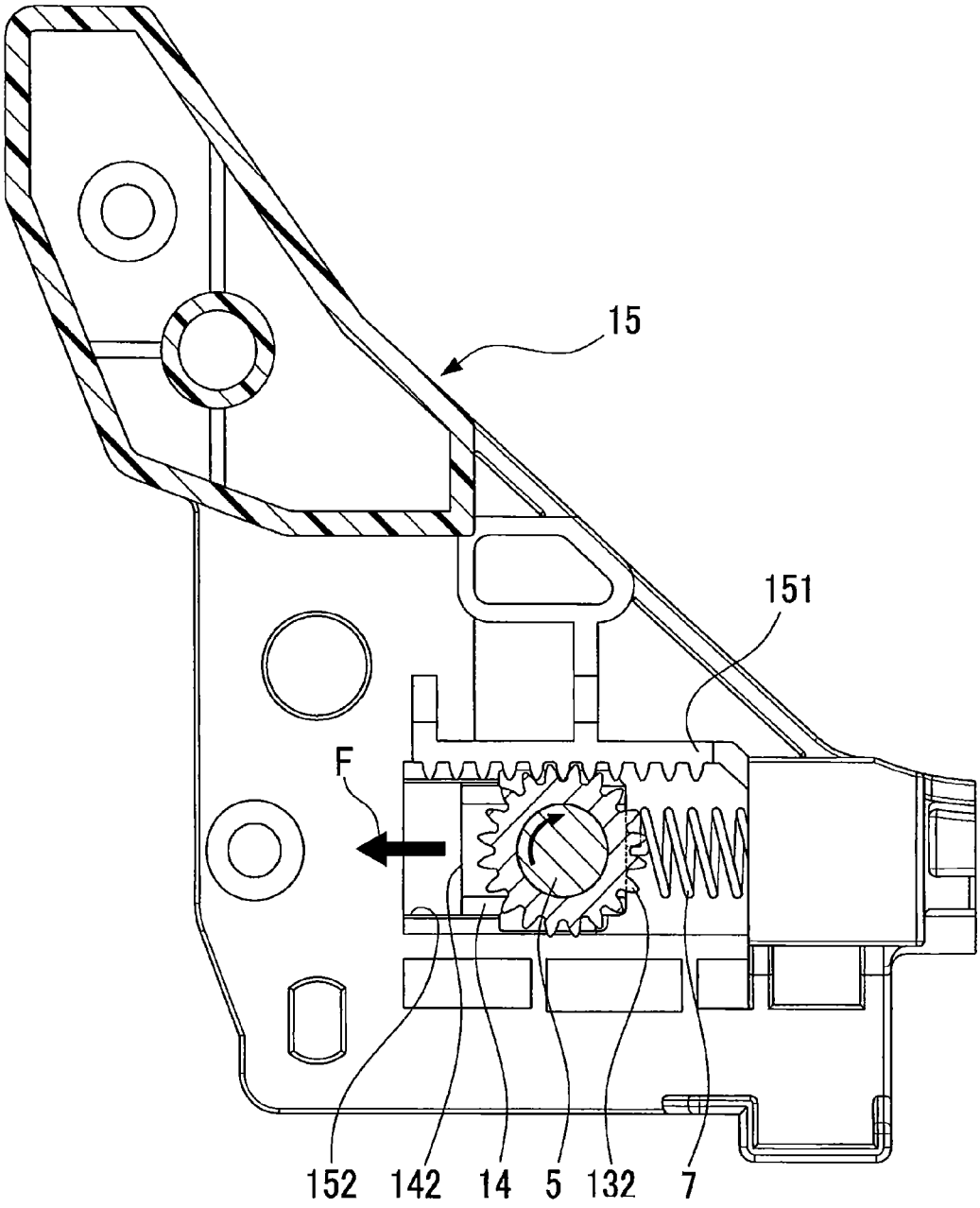
FIG. 5 is a cross-sectional view of the skew correction assembly according to the first embodiment taken along a line B-B shown in FIG. 2.

The bearing 14 rotatably supports the roller shaft 5 provided at the one axial end of the driven roller 4. That is, the one end of the roller shaft 5 is supported to the bearing 14 while extending through the flange member 11, the ring member 12, and the pinion gear member 13. The bearing 14 has an outer surface formed with a slide groove 141. The slide groove 141 is formed so as to extend in a direction perpendicular to an axial direction of the bearing 14. Furthermore, as illustrated in FIG. 5, the spring 7 is attached to the bearing 14 so as to bias the bearing 14 in a direction orthogonal to an axial direction of the roller shaft 5. The spring 7 biases the bearing 14 against a biasing reaction force from the conveyor belt 2. Here, the conveyor belt 2 has elasticity. Accordingly, when the conveyor belt 2 is biased by the spring 7 or the like, a reaction force is generated in a direction opposite to the force of biasing the conveyor belt 2 by the spring 7. In the specification, this reaction force will be referred to as a biasing reaction force.

The frame 15 is fixed to the housing (not illustrated). As illustrated in FIGS. 3 and 4, the rack gear 151 is provided at the frame 15 at a position further toward the center side than the fitting position of the bearing 14. The rack gear 151 extends in a direction perpendicular to the axial direction of the roller shaft 5. The rack gear 151 is arranged parallel to a direction in which a conveying surface of the conveyor belt 2 is moved. Note that the conveying surface of the conveyor belt 2 used herein implies a surface on which the sheet is placed and that conveys the sheet from the process unit 105 toward the fixing unit 108. In other words, the conveying surface is a portion of the conveyor belt 2 interposed between the photosensitive members 1051 and the corresponding transfer units 1055. Further, the rack gear 151 is disposed between a plane including a top edge of the drive roller 3 and a top edge of the driven roller 4 and a plane including a bottom edge of the drive roller 3 and a bottom edge of the driven roller 4 as viewed in the axial direction of the driven roller 4. As illustrated in FIGS. 4 and 5, the rack gear 151 engages with the pinion gear 132 of the pinion gear member 13 in a state where the pinion gear member 13 is assembled to the frame 15 to provide the skew correction assembly 10.

As illustrated in FIG. 5, the frame 15 is further provided with a concave portion 152 in which the bearing 14 is fitted. The bearing 14 can slide inside the concave portion 152 along the slide groove 141 in a direction parallel to the extending direction of the rack gear 151 while being assembled to the frame 15. Furthermore, as will be described later in detail, the movable range of the bearing 14 is regulated by the biasing force of the spring 7, the biasing reaction force of the conveyor belt 2, and the skew correction assembly 10.

Next, an operation of the skew correction assembly 10 according to the first embodiment will be described.

First, as illustrated in FIG. 2, in the non-pressed state, the drive roller 3 and the driven roller 4 are disposed substantially in parallel with each other. This position of the driven roller 4 is an example of an original position. Further, as illustrated in FIG. 6, in the non-pressed state, the flange member 11 and the driven roller 4 are disposed such that an end face at the center side of the flange member 11 and an end face at the end side of the driven roller 4 are close to and face each other. The non-pressed state indicates a state where the conveyor belt 2 does not skew, or a state where the edge of the conveyor belt 2 does not contact the flange portion 111 due to a small degree of the skew, or a state where the edge of the conveyor belt 2 contacts the flange portion 111 but does not press against the flange portion 111. That is, the non-pressed state corresponds to a state where the edge of the conveyor belt 2 does not apply a pressure to the flange portion 111 even when the conveyor belt 2 slightly skews. Further, as described above, in the non-pressed state, the through-holes respectively formed in the flange member 11, the ring member 12, and the pinion gear member 13 does not interrupt the rotation of the roller shaft 5. That is, the movable pieces 122 of the ring member 12 are not in engagement with the roller shaft 5. This position of the flange member 11, the ring member 12, and the pinion gear member 13 at this time is an example of a second position. The driven roller 4 is supported to the bearing 14 through the roller shaft 5, and is rotated by the circulation movement of the conveyor belt 2.

Further, as illustrated in FIG. 5, in the non-pressed state, the bearing 14 is disposed at a position where the biasing force of the spring 7 is balanced with the biasing reaction force of the conveyor belt 2. The spring 7 is selected so that the biasing reaction force of the conveyor belt 2 is appropriate in this state. The conveyor belt 2 rotates the driven roller 4 while being wound on a part of an outer periphery of the driven roller 4. Incidentally, the conveyor belt 2 may be also wound on the cylindrical surface 116 of the flange member 11. Note that, in the non-pressed state, the flange member 11 may or may not rotate along with the driven roller 4, and the ring member 12 and the pinion gear member 13 do not rotate.

When the flange portion 111 of the flange member 11 is pressed by the edge of the conveyor belt 2 due to progress of the skewness of the conveyor belt 2, the skew correction assembly 10 is moved into the pressed state as illustrated in FIG. 4. That is, the flange portion 111 is pressed toward the end side by the edge of the conveyor belt 2, and the flange member 11 moves toward the end side away from the end face of the driven roller 4.

In association with this movement of the flange member 11, the tapered portion 115 of the flange member 11 is brought into contact with the movable pieces 122 of the ring member 12 at their middle portions. When the flange member 11 is further pressed by the edge of the conveyor belt 2, the flange member 11 presses the movable pieces 122 toward the end side. As a result, the movable pieces 122 are inclined inward in the radial direction, and the free end portions of the movable pieces 122 are brought into pressure contact with the roller shaft 5. That is, the movable pieces 122 of the ring member 12 are brought into engagement with the roller shaft 5. Then, since a friction force that is generated between the free end portion of each movable piece 122 and the outer peripheral surface of the roller shaft 5 increases, the movable pieces 122 grip the roller shaft 5.

Since the free end portions of the movable pieces 122 are in pressure contact with the outer peripheral surface of the roller shaft 5 by a stronger force as a pressing force of pressing the movable pieces 122 against the roller shaft 5 increases, the friction force between the free end portions of the movable pieces 122 and the outer peripheral surface of the roller shaft 5 increases. That is, a force in which the movable pieces 122 grip the roller shaft 5 increases as the pressing force of pressing the movable pieces 122 against the roller shaft 5 increases. The movable pieces 122 are an example of a gripper.

As the movable pieces 122 grip the roller shaft 5, the ring member 12 rotates in a rotation direction the same as the rotation direction of the driven roller 4 in accordance with the rotation of the roller shaft 5.

By the gripping of the roller shaft 5, the rotational force of the driven roller 4 can be reliably transmitted to the ring member 12. Further, since the gripping force increases in response to the strength of the pressing force, the rotational force of the driven roller 4 can be more reliably transmitted to the ring member 12.

Further, the convex portions 123 of the ring member 12 are in engagement with the notches 134 of the pinion gear member 13, and hence a rotational force of the ring member 12 is transmitted to the pinion gear member 13. That is, the pinion gear member 13 also rotates in a rotation direction the same as the rotation direction of the roller shaft 5. A combination of the flange member 11, the ring member 12, and the pinion gear member 13 is an example of a rotatable assembly. Further, the flange member 11 is an example of a flange portion, and a combination of the ring member 12 and the pinion gear member 13 is an example of a gear portion. Still further, the ring member 12 is an example of a gripper and the pinion gear member 13 is an example of a receiver.

In other words, in the pressed state, the movable pieces 122 of the ring member 12 are in engagement with the roller shaft 5, and therefore, the ring member 12 and the pinion gear member 13 rotate together with the driven roller 4 through the roller shaft 5. The position of the flange member 11, the ring member 12, and the pinion gear member 13 at this time is an example of a first position.

Further, since the pinion gear 132 is in meshing engagement with the rack gear 151 of the frame 15, the pinion gear 132 moves along the rack gear 151.

Here, since the outer diameter of the pinion gear 132 is larger than the outer diameter of the roller shaft 5 and smaller than the outer diameter of the driven roller 4, a force of moving the pinion gear 132 along the rack gear 151 can be made greater.

In addition, since the roller shaft 5 extends through the ring member 12 and the pinion gear member 13, the roller shaft 5 moves linearly in accordance with the movement of the pinion gear member 13 along the rack gear 151. Specifically, when the pinion gear 132 rotates in the rotation direction the same as the rotation direction of the roller shaft 5, the roller shaft 5 is moved in a direction away from the drive roller 3 as indicated by the arrow F in FIG. 5. The pinion gear 132 is an example of a first gear. The rack gear 151 is an example of a second gear.

By virtue of the configuration in which the pinion gear 132 and the rack gear 151 meshingly engage with each other, the roller shaft 5 can be moved by using the rotation of the driven roller 4. Further, the rotatable assembly (the flange member 11, the ring member 12, and the pinion gear member 13) is configured to start rotating when receiving a pressing force larger than a predetermined value from the conveyor belt 2. With this configuration, the roller shaft 5 can be prevented from moving when the pressing force is small, and hence the circulation speed of the conveyor belt 2 can be stabilized.

While the roller shaft 5 is moved in the direction away from the drive roller 3 in response to the movement of the pinion gear member 13 along the rack gear 151, the roller shaft 6 to which the skew correction assembly 10 is not attached and that is supported to the housing (not illustrated) does not move. Hence, as described above, the driven roller 4 is inclined with respect to the drive roller 3 when the one axial end of the driven roller 4 is displaced. The position of the driven roller 4 at this time is an example of a displaced position. Then, the tensile force of the conveyor belt 2 at one side that is close to the skew correction assembly 10 becomes larger than the tensile force of the conveyor belt 2 at the other side away from the skew correction assembly 10. Since the conveyor belt 2 moves from the side where the tensile force is larger toward the side where the tensile force is smaller, the conveyor belt 2 on the driven roller 4 moves toward the center side, that is, in a direction away from the skew correction assembly 10.

In association with this movement of the conveyor belt 2, the skewness is corrected, and the pressure applied to the flange portion 111 from the edge of the conveyor belt 2 decreases. Then, the pressing force applied from the flange member 11 to the ring member 12 also decreases. As a result, the skew correction assembly 10 is moved into the non-pressed state as illustrated in FIG. 6. At this time, the free end portions of the movable pieces 122 move outward in the radial direction away from the roller shaft 5 by their restoring forces. That is, engagement of the movable pieces 122 of the ring member 12 with the roller shaft 5 is released. Accordingly, the rotation of the roller shaft 5 is not transmitted to the ring member 12.

In the non-pressed state, the ring member 12 and the pinion gear member 13 do not receive the rotational force of the roller shaft 5. Thus, the rotational force of the roller shaft 5 is not transmitted to the pinion gear 132. That is, the roller shaft 5 can freely rotate while extending through the flange member 11, the ring member 12, and the pinion gear member 13.

In other words, in the non-pressed state where the conveyor belt 2 does not skew, the driven roller 4 is rotatable relative to the flange member 11, the ring member 12, and the pinion gear member 13. With this configuration, there is a small influence on the control for the rotation of the driven roller 4.

Further, in the non-pressed state, the pinion gear 132 of the pinion gear member 13 can freely rotate regardless of the rotation of the roller shaft 5.

When the skew correction assembly 10 is moved into the pressed state from the non-pressed state, the roller shaft 5 is moved by the skew correction assembly 10. This increases the biasing reaction force of the conveyor belt 2. When the skew correction assembly 10 returns to the non-pressed state, the force of displacing the roller shaft 5 disappears. For this reason, the roller shaft 5 returns to a position where the biasing reaction force of the conveyor belt 2 is equal to the biasing force of the spring 7. That is, the pinion gear 132 is rotated in reverse, and the roller shaft 5 moves in a direction opposite to the direction indicated by the arrow F in FIG. 5. Hence, the driven roller 4 is returned to a position substantially parallel to the drive roller 3. That is, the driven roller 4 restores its original position. At this time, the ring member 12 also rotates in association with the rotation of the pinion gear 132. However, since the movable pieces 122 do not grip the roller shaft 5 in the non-pressed state, the rotation of the driven roller 4 is not influenced by the rotation of the ring member 12.

In other words, when the skew correction assembly 10 is moved into the non-pressed state from the pressed state, the driven roller 4 returns to its original position in which the driven roller 4 is positioned before the skew correction assembly 10 displaces the roller shaft 5. When the skewness of the conveyor belt 2 is corrected by the movement of the driven roller 4, the pressing force applied from the conveyor belt 2 to the flange member 11 disappears. In this state, it is desirable to return the driven roller 4 to the original position, which can suppress the conveyor belt 2 from skewing toward the center side.

It should be noted that the movable range of the bearing 14 in the pressed state is limited. That is, when the roller shaft 5 is moved away from the drive roller 3 by the skew correction assembly 10, the conveyor belt 2 is stretched. Thus, the force of the conveyor belt 2 moving the roller shaft 5 toward the drive roller 3 increases. Accordingly, the roller shaft 5 is moved toward the drive roller 3 against the force of gripping the roller shaft 5 by the movable pieces 122. That is, when the biasing reaction force of the conveyor belt 2 is equal to the force of moving the roller shaft 5 by the skew correction assembly 10, the bearing 14 does not move any more. At this movable limit position of the bearing 14, the roller shaft 5 rotates while sliding on the movable pieces 122 of the ring member 12. That is, the inner surfaces of the free end portions of the movable pieces 122 slide over the roller shaft 5 when the bearing 14 is at the movable limit position. Accordingly, the rotation of the ring member 12 is stopped, while the rotation of the roller shaft 5 is continued.

If the rotational force of the driven roller 4 is further transmitted to the ring member 12 even when the bearing 14 is at the movable limit position, there is a concern that the rotation state of the driven roller 4 may become unstable. For this reason, it is desirable to continue the rotation of the driven roller 4 even when the rotation of the ring member 12 is stopped.

As described above in detail, the MFP 100 that includes the skew correction assembly 10 according to the first embodiment includes the flange member 11, the ring member 12, the pinion gear member 13, and the rack gear 151. When the conveyor belt 2 skews toward the end side, the conveyor belt 2 contacts the flange portion 111 of the flange member 11, and applies the pressing force in a direction toward the end side to the flange member 11. By this pressing force, the ring member 12 receives the rotational force of the roller shaft 5 and rotates together with the roller shaft 5. When the ring member 12 rotates, the roller shaft 5 is moved by the pinion gear member 13 and the rack gear 151. This moving direction of the roller shaft 5 indicates a direction in which the skewness of the conveyor belt 2 is corrected. Accordingly, the skewness of the conveyor belt 2 can be regulated.

As a result, damages in the conveyor belt 2 such as breakage or deformation of the edge of the conveyor belt 2 can be suppressed.

Further, the direction in which the roller shaft 5 is moved is a direction in which the tensile force of the conveyor belt 2 increases. Since the roller shaft 5 is moved in a direction in which the tensile force increases, the conveyor belt 2 can be moved toward the roller shaft 6. Hence, the conveying surface of the conveyor belt 2 is less distorted, which facilitates smooth and stable conveyance of the sheet by the conveyor belt 2.

Further, the skew correction assembly 10 is provided at the driven roller 4, and the roller shaft 5 provided at the driven roller 4 is displaced for correcting the skewness of the conveyor belt 2. Thus, an influence on a drive motor (not illustrated) caused by the displacement of the driven roller 4 can be made smaller, compared to a case where the skew correction assembly 10 is provided at the drive roller 3 and the roller shaft provided at the drive roller 3 is displaced. Accordingly, the rotation of the drive roller 3 can be stabilized.

Next, the skew correction assembly 20 according to the second embodiment will be described.

Figure 7:
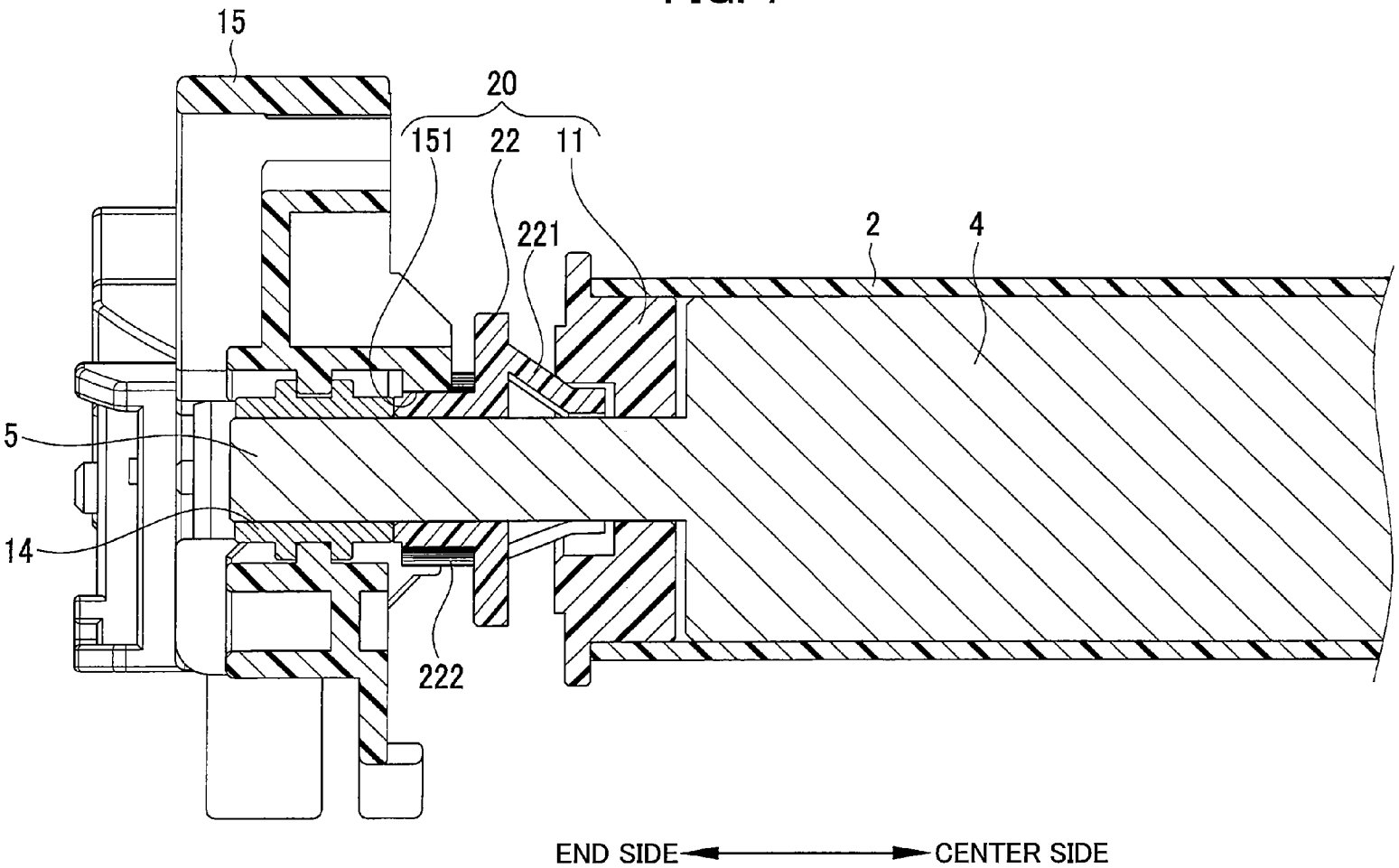
FIG. 7 is a cross-sectional view of a skew correction assembly according to a second embodiment.

As illustrated in FIG. 7, the skew correction assembly 20 is different from the skew correction assembly 10 according to the first embodiment in that a gear member 22 is provided instead of the ring member 12 and the pinion gear member 13. The same reference numerals will be given to the same components as those of the skew correction assembly 10, and the description thereof will be omitted. Specifically, the flange member 11, the bearing 14, and the frame 15 are the same as those of the skew correction assembly 10. That is, the configuration of the skew correction assembly 20 other than the gear member 22 is similar to that of the skew correction assembly 10.

The gear member 22 of the skew correction assembly 20 is a resinous member in which the ring member 12 and the pinion gear member 13 of the skew correction assembly 10 are integrated with each other. The gear member 22 includes movable pieces 221 and a pinion gear 222. The operation of the skew correction assembly 20 is similar to the operation of the skew correction assembly 10.

In the second embodiment, a combination of the flange member 11 and the gear member 22 is an example of the rotatable assembly. Further, the flange member 11 is an example of the flange portion and the gear member 22 is an example of the gear portion.

Accordingly, even in the skew correction assembly 20, the skewness of the conveyor belt 2 can be corrected similarly to the skew correction assembly 10. The skew correction assembly 20 is advantageous in that the number of components constituting the skew correction assembly 20 can be smaller than that of the skew correction assembly 10. Meanwhile, it is assumed that the metallic movable pieces 122 of the skew correction assembly 10 have higher durability with respect to repeated deformation compared to the resinous movable piece 221 of the skew correction assembly 20. That is, compared to the skew correction assembly 10, the skew correction assembly 20 is suitable for the MFP 100 in which the skew of the conveyor belt 2 occurs less frequently.

Next, the skew correction assembly 30 according to the third embodiment will be described.

Figure 8:
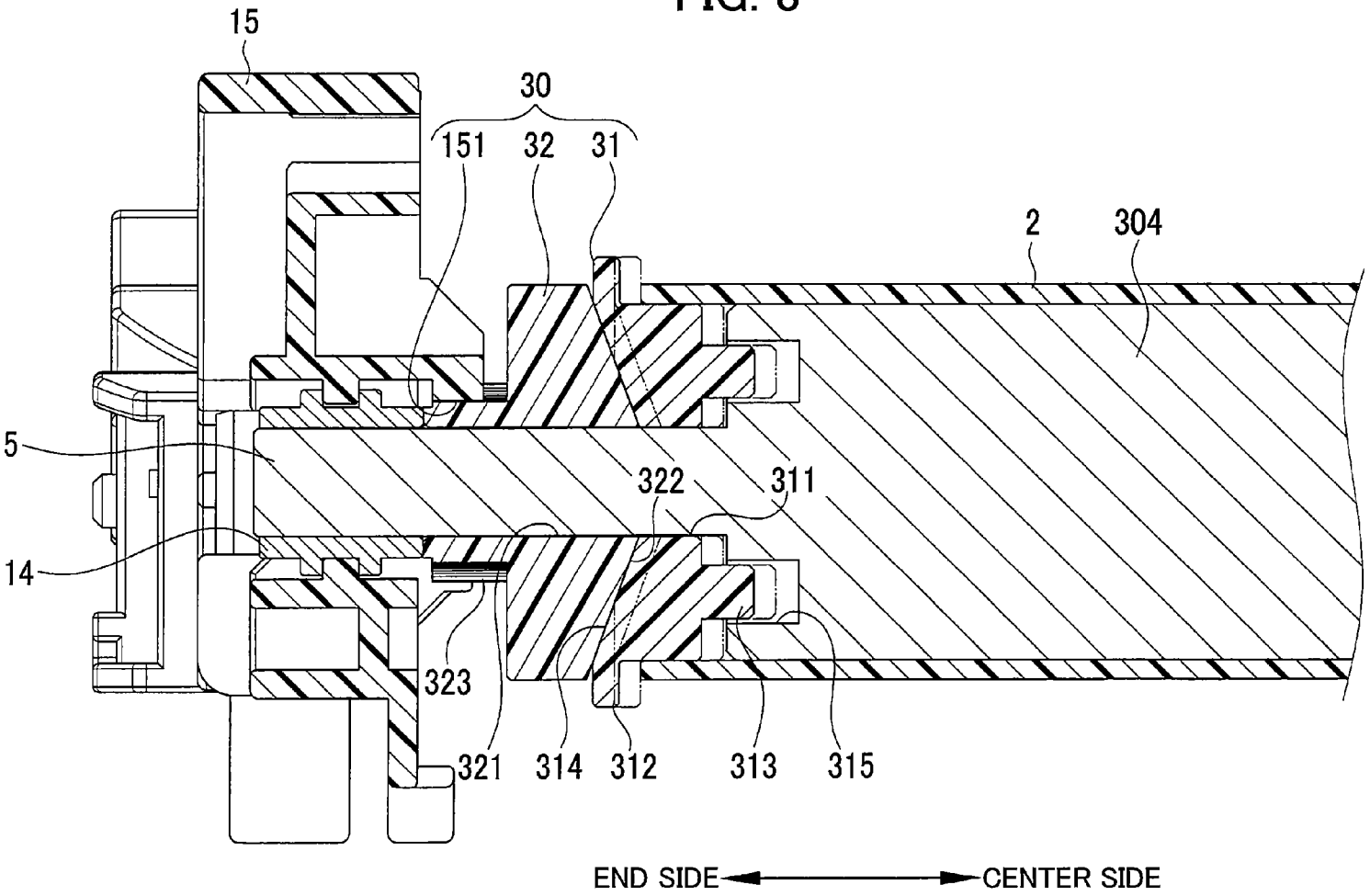
FIG. 8 is a cross-sectional view of a skew correction assembly according to a third embodiment.

As illustrated in FIG. 8, the skew correction assembly 30 is different from the skew correction assembly 10 according to the first embodiment in that a flange member 31 and a gear member 32 are provided instead of the flange member 11, the ring member 12, and the pinion gear member 13. Further, in the third embodiment, a driven roller 304 has a concave portion 315 at its end face. The same reference numerals will be given to the same components as those of the skew correction assembly 10, and the description thereof will be omitted. Specifically, the bearing 14 and the frame 15 are the same as those of the skew correction assembly 10. Further, in FIG. 8, the pressed state is indicated by the solid line, and the non-pressed state is indicated by the two-dotted chain line.

The flange member 31 and the gear member 32 of the skew correction assembly 30 are formed of resin. A thorough-hole 311 is formed in the flange member 31 to provide an inner peripheral surface thereof. A through-hole 321 is formed in the gear member 32 to provide an inner peripheral surface thereof. Both a diameter of the through-hole 311 and a diameter of the through-hole 321 are larger than the outer diameter of the roller shaft 5. The roller shaft 5 is supported to the bearing 14 while extending through the through-hole 311 and the through-hole 321.

The flange member 31 includes a flange portion 312, a convex portion 313, and a tapered concave portion 314. The flange portion 312 has a configuration similar to that of the flange portion 111 of the first skew correction assembly 10. The convex portion 313 is disposed at the center side of the flange portion 312 and removably inserted into the concave portion 315 formed on the end face of the driven roller 304. That is, the flange member 31 is attached to the driven roller 304 by fitting the convex portion 313 into the concave portion 315, while being movable relative to the driven roller 304 in the axial direction. In the pressed state where the flange portion 312 is pressed toward the end side by the skewed conveyor belt 2, the flange member 31 is disposed at a position toward the end side further than the center side. That is, the flange member 31 is movable between the position in the non-pressed state near the center side indicated by the two-dotted chain line in FIG. 8 and the position in the pressed state near the end side indicated by the solid line in FIG. 8.

The tapered concave portion 314 is a tapered surface that is formed in an end face at the end side of the flange member 31. The tapered concave portion 314 has a diameter that grows smaller toward the center side. That is, the end face at the end side of the flange member 31 is depressed in a direction from the end side to the center side.

The gear member 32 includes a tapered convex portion 322 and a pinion gear 323. The tapered convex portion 322 is provided at the center side of the gear member 32, while the pinion gear 323 is provided at the end side of the gear member 32. The tapered convex portion 322 has a tapered surface whose diameter grows larger toward the end side, and a radially center portion that protrudes toward the center side. The tapered surface of the tapered concave portion 314 of the flange member 31 and the tapered surface of the tapered convex portion 322 of the gear member 32 are formed so as to have the same angle. Accordingly, as illustrated in FIG. 8, the tapered concave portion 314 and the tapered convex portion 322 can make surface-contact with each other.

Next, an operation of the skew correction assembly 30 according to the third embodiment will be described. In the non-pressed state where the skew correction assembly 30 is not pressed by the edge of the conveyor belt 2, a gap is formed between the tapered concave portion 314 of the flange member 31 and the tapered convex portion 322 of the gear member 32 as indicated by the two-dotted chain line in FIG. 8. Hence, in the non-pressed state, the tapered concave portion 314 and the tapered convex portion 322 do not contact each other. Alternatively, the tapered concave portion 314 and the tapered convex portion 322 may slightly contact each other so as to be relatively rotatable even when both portions contact each other. Note that the flange member 31 rotates along with the driven roller 304 in both the non-pressed state and the pressed state.

When the conveyor belt 2 skews, the skew correction assembly 30 is moved into the pressed state where the flange portion 312 of the flange member 31 is pressed by the edge of the conveyor belt 2 toward the end side. In the pressed state, the flange member 31 moves toward the end side as indicated by the solid line in FIG. 8. Thus, the tapered concave portion 314 of the flange member 31 and the tapered convex portion 322 of the gear member 32 are brought into pressure contact with each other. That is, a grip force between the gear member 32 and the flange member 31 increases.

As a result, the rotation of the roller shaft 5 is transmitted to the gear member 32 through the rotation of the flange member 31. Accordingly, the pinion gear 323 rotates along with the driven roller 304. The subsequent steps are similar to those of the skew correction assembly 10, and the description thereof will be omitted.

In the third embodiment, a combination of the flange member 31 and the gear member 32 is an example of the rotatable assembly. Further, the flange member 31 is an example of the flange portion, and the gear member 32 is an example of the gear portion.

As described above in detail, even in the MFP 100 that includes the skew correction assembly 30 according to the third embodiment, the position of the roller shaft 5 is displaced by applying the pressure from the conveyor belt 2 to the skew correction assembly 30. Accordingly, the skewness of the conveyor belt 2 can be regulated similarly to the skew correction assembly 10 according to the first embodiment.

Next, the skew correction assembly 40 according to the fourth embodiment will be described.

Figure 9:
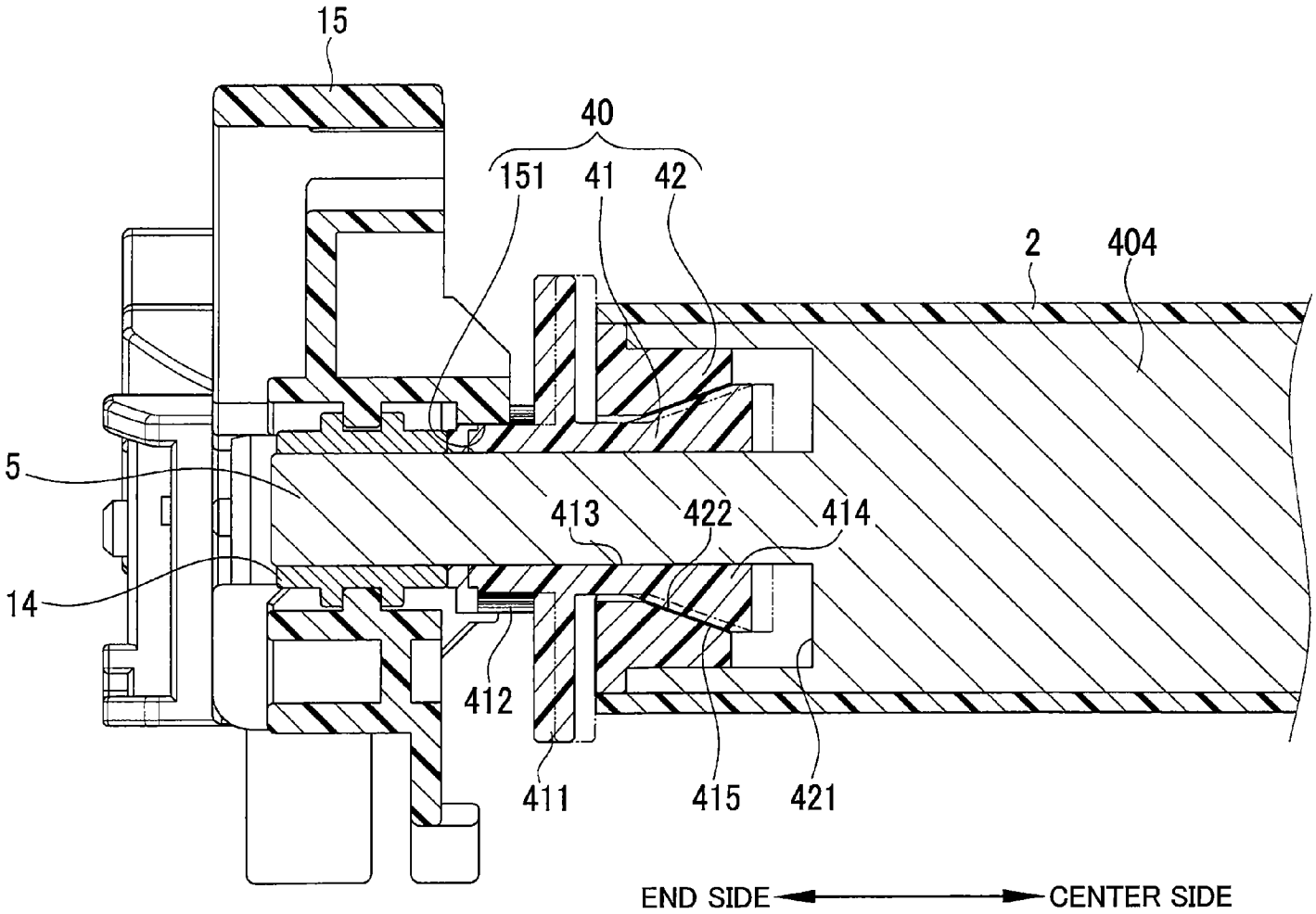
FIG. 9 is a cross-sectional view of a skew correction assembly according to a fourth embodiment.

As illustrated in FIG. 9, the skew correction assembly 40 is different from the skew correction assembly 10 according to the first embodiment in that a flange member 41 and an inner ring member 42 are provided instead of the flange member 11, the ring member 12, and the pinion gear member 13. Further, in the fourth embodiment, the driven roller 404 has an annular concave portion 421 at the end side thereof. The same reference numerals will be given to the same components as those of the skew correction assembly 10, and the description thereof will be omitted. Specifically, the bearing 14 and the frame 15 are the same as those of the skew correction assembly 10. Further, in FIG. 9, the pressed state is indicated by the solid line, and the non-pressed state is indicated by the two-dotted chain line.

The flange member 41 and the inner ring member 42 of the skew correction assembly 40 are formed of resin. The flange member 41 is provided with a flange portion 411 and a pinion gear 412 at its outer peripheral side, and has a through-hole 413 at its inner peripheral side. The through-hole 413 allows the roller shaft 5 to rotatably extend therethrough. Further, the flange member 41 is provided with an annular convex portion 414 whose diameter grows larger toward the center side. The annular convex portion 414 is disposed at a position toward the center side from the flange portion 411. An outer peripheral surface of the annular convex portion 414 is formed as a tapered surface 415 whose diameter grows larger toward the center side.

The flange member 41 moves toward the end side when the flange portion 411 is pressed toward the end side by the skewed conveyor belt 2. That is, the flange member 41 is movable between the position in the non-pressed state near the center side indicated by the two-dotted chain line in FIG. 9 and the position in the pressed state near the end side indicated by the solid line of FIG. 9.

The inner ring member 42 is substantially formed in an annular shape and is fixed to an end face at the end side of the driven roller 304. More specifically, the inner ring member 42 is fixed to a peripheral edge at the end side of the annular concave portion 421 formed around the roller shaft 5. The inner peripheral surface of the inner ring member 42 is formed as a tapered surface 422 whose diameter grows smaller toward the end side. Further, a space is formed between the tapered surface 422 and the outer peripheral surface of the roller shaft 5.

Next, an operation of the skew correction assembly 40 according to the fourth embodiment will be described. In the non-pressed state where the conveyor belt 2 does not skew, the flange member 41 and the inner ring member 42 do not contact each other as indicated by the two-dotted chain line in FIG. 9. At this time, the inner ring member 42 rotates along with the driven roller 404. Further, the roller shaft 5 is rotatably inserted through the through-hole 413 of the flange member 41, and thus, the flange member 41 does not rotate.

When the skew of the conveyor belt 2 occurs, the skew correction assembly 40 is moved into the pressed state where the flange portion 411 of the flange member 41 is pressed toward the end side by the edge of the conveyor belt 2. In the pressed state, the flange member 41 moves toward the end side as indicated by the solid line in FIG. 9, and the tapered surface 415 of the flange member 41 and the tapered surface 422 of the inner ring member 42 are brought into pressure contact with each other. The tapered surfaces 415, 422 are brought into pressure contact with each other, whereby a grip force between the flange member 41 and the inner ring member 42 increases.

As a result, the rotation of the roller shaft 5 is transmitted to the flange member 41 through the inner ring member 42. Accordingly, the pinion gear 412 rotates along with the driven roller 404. The subsequent steps are similar to those of the skew correction assembly 10, and the description thereof will be omitted.

In the fourth embodiment, a combination of the flange member 41 and the inner ring member 42 is an example of the rotatable assembly. Further, the flange portion 411 is an example of the flange portion, and the pinion gear 412 is an example of the gear portion.

As described above in detail, even in the MFP 100 that includes the skew correction assembly 40 according to the fourth embodiment, the position of the roller shaft 5 is displaced by applying the pressure from the conveyor belt 2 to the skew correction assembly 40. Accordingly, the skewness of the conveyor belt 2 can be regulated similarly to the skew correction assembly 10 according to the first embodiment.

Next, the skew correction assembly 50 according to the fifth embodiment will be described.

Figure 10:
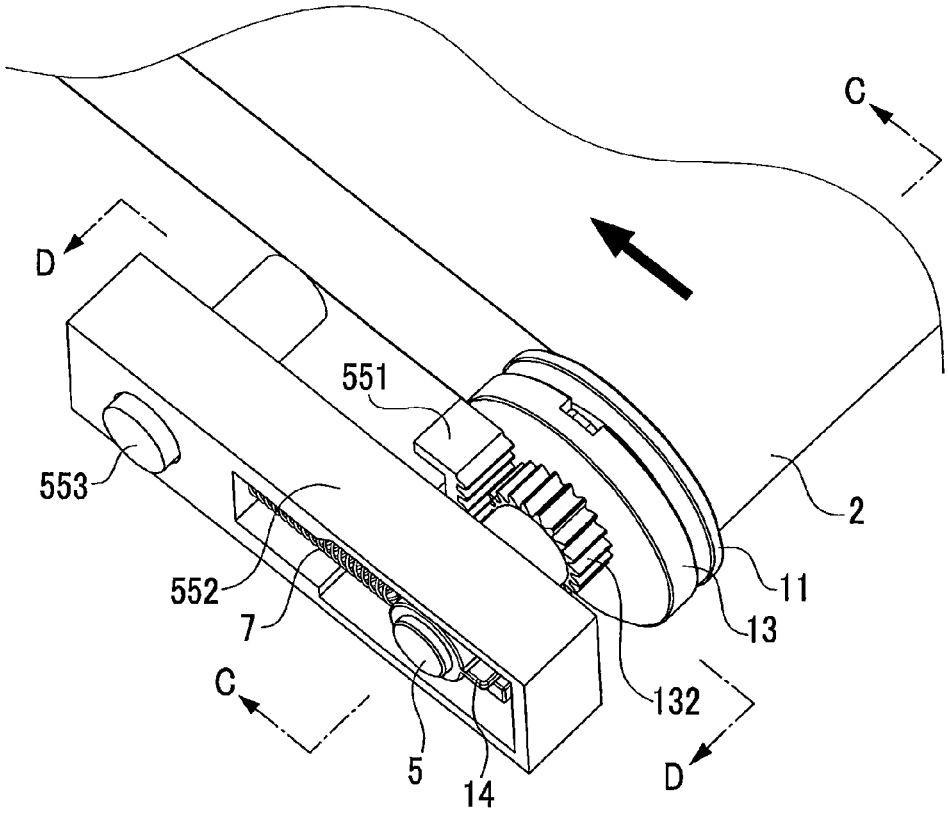
FIG. 10 is a perspective view of a skew correction assembly according to a fifth embodiment.
Figure 11:
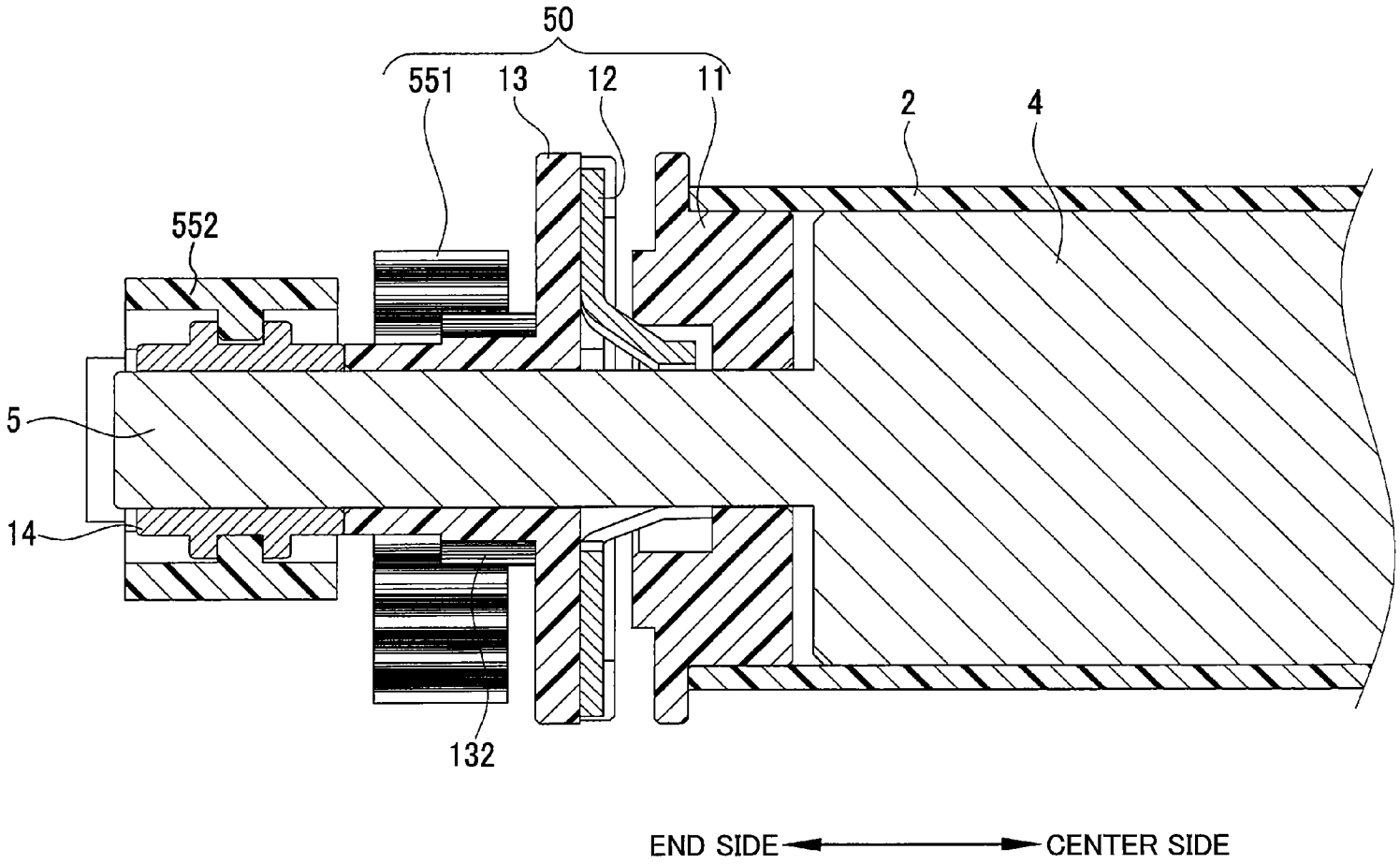
FIG. 11 is a cross-sectional view of the skew correction assembly according to the fifth embodiment taken along a line C-C shown in FIG. 10.
Figure 12:
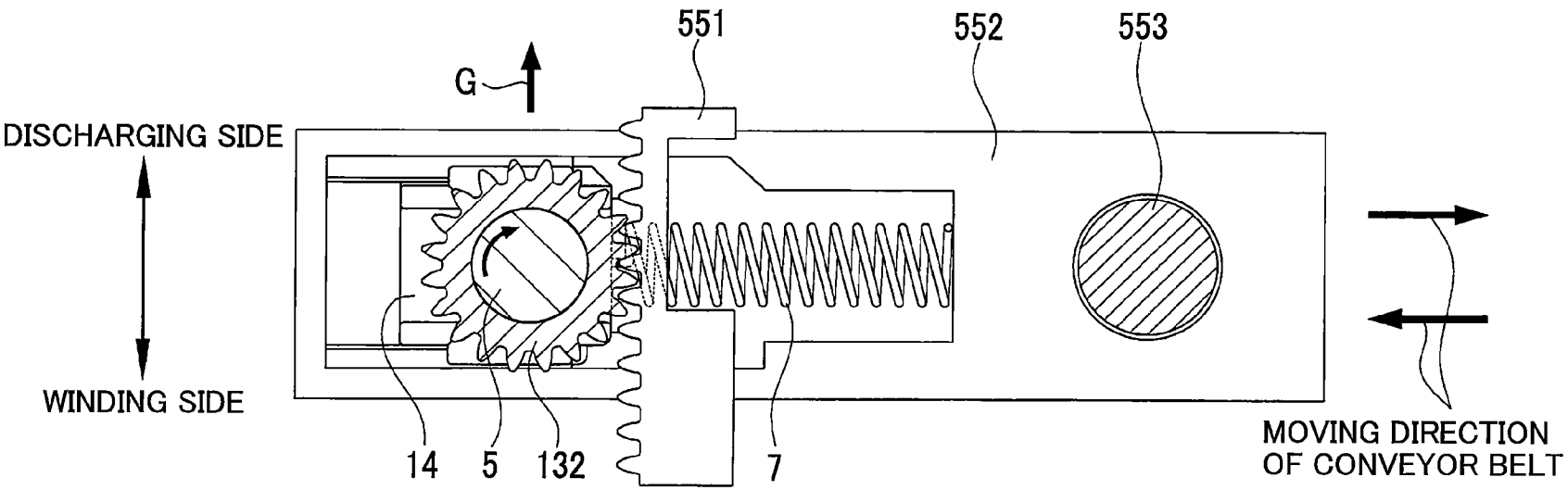
FIG. 12 is a cross-sectional view of the skew correction assembly according to the fifth embodiment taken along a line D-D shown in FIG. 10.

As illustrated in FIGS. 10, 11, and 12, the skew correction assembly 50 is different from the skew correction assembly 10 according to the first embodiment in that a rack gear 551 as an example of the second gear is provided instead of the rack gear 151. The same reference numerals will be given to the same components as those of the skew correction assembly 10, and the description thereof will be omitted. Specifically, the flange member 11, the ring member 12, the pinion gear member 13, and the bearing 14 are the same as those of the skew correction assembly 10.

The skew correction assembly 50 is the same as the skew correction assembly 10 in terms of the portion that is pressed by the skewed conveyor belt 2 (i.e. the flange portion 111 of the flange member 11), the portion that is moved during transition from the non-pressed state to the pressed state (i.e. the movable pieces 122 of the ring member 12), and the portion that is rotated by the rotation of the roller shaft 5 in the pressed state (i.e. the pinion gear 132 of the pinion gear member 13). That is, even in the skew correction assembly 50, the pinion gear 132 rotates in association with the rotation of the roller shaft 5 due to the skew of the conveyor belt 2.

In the skew correction assembly 50, as illustrated in FIGS. 10 and 12, the roller shaft 5 is supported to a bearing box 552 through the bearing 14. The bearing box 552 is supported to the housing (not illustrated) through a pivot shaft 553 fixed to the housing, and is pivotally movable relative to the housing. That is, in the fifth embodiment, the roller shaft 5 is pivotally movable about the pivot shaft 553 in association with the pivotal movement of the bearing box 552.

The rack gear 551 is fixed to the housing (not illustrated) separately from the bearing box 552. The direction in which the rack gear 551 extends is different from that of the rack gear 151 in the skew correction assembly 10. Specifically, as illustrated in FIGS. 10 and 12, the rack gear 551 is formed so as to extend in a direction perpendicular to the plane including the axis of the drive roller 3 and the axis of the driven roller 4. With this configuration, the roller shaft 5 moves in the direction perpendicular to the plane including the axis of the drive roller 3 and the axis of the driven roller 4 in accordance with the rotation of the pinion gear 132. That is, the skew correction assembly 50 is different from the skew correction unit 10 in that the skew correction assembly 50 displaces the roller shaft 5 in a direction different from a direction in which the skew correction assembly 10 displaces the roller shaft 5. The position of the driven roller 4 when the roller shaft 5 is displaced upward in association with the rotation of the pinion gear pinion gear 132 is an example of a displaced position.

Even in the skew correction assembly 50, the pinion gear 132 does not rotate in the non-pressed state similarly to the skew correction assembly 10. The bearing box 552 is oriented in a direction such that both the roller shaft 5 and the pivot shaft 553 are disposed between the plane including the top edge of the drive roller 3 and the top edge of the driven roller 4 and the plane including the bottom edge of the drive roller 3 and the bottom edge of the driven roller 4 as viewed in the axial direction of the driven roller 4.

When the skew correction assembly 50 is moved into the pressed state after the flange member 11 is pressed by the skewed conveyor belt 2, the pinion gear 132 rotates similarly to the skew correction assembly 10. As a result, the pinion gear 132 moves along the rack gear 551 in a direction perpendicular to the conveying surface of the conveyor belt 2. Specifically, the pinion gear 132 moves from a winding side in which the conveyor belt 2 is wound on the driven roller 4 toward a discharging side in which the conveyor belt 2 is discharged from the driven roller 4 toward the drive roller 3. In other words, the driven roller 4 has an inlet generatrix at which the conveyor belt 2 is about to contact the driven roller 4 to be would on the driven roller 4, and an outlet generatrix at which the conveyor belt 2 is discharged from the driven roller 4 toward the drive roller 3.

This moving direction of the pinion gear 132 is indicated by the arrow G in FIG. 12. The roller shaft 5 rotates in the clockwise direction in FIG. 12. That is, the conveyor belt 2 is wound on the driven roller 4 from a downside in FIG. 12, and moved from the downside in FIG. 12 to an upside in FIG. 12, and then, moved toward the drive roller 3 from the upside in FIG. 12. Note that, in FIG. 10, an arrow indicated within the conveyor belt 2 indicates a direction in which a visible surface (i.e. conveying surface) of the conveyor belt 2 moves.

When the roller shaft 5 displaces from the winding side toward the discharging side, the path of the conveyor belt 2 changes in the winding portion of the conveyor belt 2 (i.e.

the portion of the conveyor belt 2 wound on the driven roller 4). Specifically, at the position where the conveyor belt 2 is wound on the driven roller 4, the conveyor belt 2 is first fed along a moving direction of an outer peripheral surface of the drive roller 4, and then moves in a direction orthogonal to the roller shaft 5. Hence, when the roller shaft 5 is displaced from the winding side toward the discharging side, the conveyor belt 2 moves from the end side toward the center side in FIG. 11. That is, the conveyor belt 2 moves in a direction away from the skew correction assembly 50. Accordingly, the skewness of the conveyor belt 2 is corrected. In order to correct the skewness, the moving (displaced) direction of the roller shaft 5 needs to be a direction including at least a directional component directed from the winding side toward the discharging side. For example, the moving direction of the roller shaft 5 may be a direction toward the drive roller 3 within a range in which the biasing reaction force of the conveyor belt 2 can be maintained.

By moving the roller shaft 5 from the winding side toward the discharging side, the conveyor belt 2 can be moved toward the center side to correct the skewness of the conveyor belt 2. In this way, the driven roller 4 can be moved easily, reducing load applied to the conveyor belt 2.

Furthermore, in this embodiment, as described above, the bearing box 552 is pivotally movable about the pivot shaft 553. With this configuration, when the roller shaft 5 is moved from the winding side to the discharging side in association with the rotation of the pinion gear 132, the bearing box 552 is pivotally moved, and the bearing 14 moves inside the bearing box 552. Since the moving direction of the roller shaft 5 is an upward direction as indicated by the arrow G in FIG. 12, the direction of gravity is a direction in which the roller shaft 5 is returned to its original position in the non-pressed state. Hence, when the skew correction assembly 50 returns to the non-pressed state after the skewness of the conveyor belt 2 is corrected in the pressed state, the bearing box 552 and the roller shaft 5 return to their original positions by the gravity. The force for moving the conveyor belt 2 from the end side toward the center side in FIG. 11 becomes greater as the roller shaft 5 moves upward, and therefore the skew correction assembly 50 is moved into the non-pressed state. Further, the initial position of the bearing box 552 is determined by a stopper (not illustrated), so that the bearing box 552 does not move downward further than the initial position. In other words, the bearing box 552 cannot pivotally move from the horizontal position in FIG. 12 in a direction in which the roller shaft 5 moves further downward than its position illustrated in FIG. 12.

Even in this embodiment, the movable range of the bearing 14 is limited similarly to the first embodiment. For example, a stopper (not illustrated) is provided for regulating the movement of the bearing 14. The stopper contacts the bearing box 552 when the bearing 14 moves in a direction indicated by the arrow G in FIG. 12, thereby regulating the bearing 14 from moving further upward. Thus, the movable limit position of the bearing 14 is set to a position in which the bearing box 552 contacts the stopper. When the pressed state is maintained even after the bearing 14 reaches the movable limit position, the movable pieces 122 slide over the roller shaft 5, and the driven roller 4 continuously rotates.

As described above in detail, even in the MFP 100 that includes the skew correction assembly 50 according to the fifth embodiment, the position of the roller shaft 5 is displaced by applying the pressure from the conveyor belt 2 to the skew correction assembly 50. Accordingly, the skewness of the conveyor belt 2 can be regulated similarly to the skew correction assembly 10 according to the first embodiment.

While the description has been made in detail with reference to the embodiment thereof, it would be apparent to those skilled in the art that various changes and modifications may be made therein without departing from the spirit of the above-described embodiments.

The disclosure is not limited to the MFP, and may also be applied to any image forming apparatus as long as a conveyor belt and an image forming function are provided. For example, the disclosure may be available for a copy machine, a scanner, and a facsimile.

Further, the direction in which the rack gear 151 extends may not be a direction precisely parallel to the conveying surface of the conveyor belt 2. Still further, the direction in which the rack gear 551 extends may not be a direction precisely perpendicular to the conveying surface of the conveyor belt 2. For example, these directions may be inclined by a predetermined angle with respect to the precisely parallel or perpendicular direction.

Further, in the fifth embodiment, the moving direction of the roller shaft 5 is changed from that in the first embodiment. However, the same effect may be obtained even when the moving direction of the roller shaft 5 in the second to fourth embodiments is changed by replacing the rack gear 151 in the second to fourth embodiments with the rack gear 551 in the fifth embodiment.

Further, for example, the number of the rollers around which the conveyor belt 2 is stretched is not limited to two, and may be three or more. Further, the roller at which the skew correction assembly is provided is not limited to the driven roller 4, and may be the drive roller 3.

Further, for example, the component subject to skew correction is not limited to the conveyor belt 2 that conveys the sheet, and may be also an intermediate transfer belt or a fixing belt.

Further, in the first through fifth embodiments, the driven roller 4 is provided with the roller shafts 5 and 6 at axial end portions thereof. The roller shafts 5 and 6 may be integrally formed and extend through the driven roller 4.

What is claimed is:

1. A belt conveying device comprising:

a first roller having an axis extending in an axial direction, the first roller having a first end portion on a first side in the axial direction and a second end portion on a second side opposite to the first side in the axial direction;

a second roller;

a belt configured to be looped taut around the first roller and the second roller;

a rotatable assembly having a first gear and provided at the first end portion, the rotatable assembly being configured to provide a first position to engage with the first roller and to rotate upon receipt of a friction force generated between the rotatable assembly and the first roller, and a second position to be disengaged from the first roller; and a frame having a second gear arranged in a prescribed direction, the second gear engaging with the first gear.

2. The belt conveying device as claimed in claim 1, wherein the prescribed direction is a direction for increasing a tensile force of the belt.

3. The belt conveying device as claimed in claim 1, wherein the first roller defines an inlet generatrix at which the belt is about to contact the first roller to be wound on the first roller and an outlet generatrix at which the belt is discharged from the first roller toward the second roller, and wherein the prescribed direction is a direction including a directional component directed from the inlet generatrix toward the outlet generatrix.

4. The belt conveying device as claimed in claim 1, wherein the first roller has a rotation shaft provided at the first end portion of the first roller, and wherein the rotatable assembly comprises a gripper configured to grip the rotation shaft with a gripping force variable in strength.

5. The belt conveying device as claimed in claim 4, wherein the gripper is configured such that the gripping force increases as pressure applied to the rotatable assembly from the belt increases.

6. The belt conveying device as claimed in claim 1, wherein the rotatable assembly is configured to start rotating when pressure applied to the rotatable assembly from the belt becomes greater than a predetermined value.

7. The belt conveying device as claimed in claim 1, wherein the first gear is a pinion gear, and wherein the second gear is a rack gear.

8. The belt conveying device as claimed in claim 7, wherein the first roller comprises a roller body and a rotation shaft extending from the roller body and positioned at the first end portion of the first roller, and wherein the pinion gear has a diameter greater than a diameter of the rotation shaft and smaller than a diameter of the roller body.

9. The belt conveying device as claimed in claim 1 , wherein the rotatable assembly is configured to release engagement with the first roller to stop the rotation of the rotatable assembly with maintaining the rotation of the first roller when the first end portion reaches a movable limit position in which further movement of the first end portion by the second gear is restricted as a result of continuous pressure application to the rotatable assembly from the belt.

10. The belt conveying device as claimed in claim 1, wherein the first roller is movable between an original position and a displaced position provided by movement of the first end portion in the prescribed direction by the second gear, the first roller being configured to restore the original position from the displaced position when pressure application to the rotatable assembly from the belt is released.

11. The belt conveying device as claimed in claim 1, wherein the rotatable assembly is rotatable relative to the first roller when the rotatable member is free from pressure from the belt.

12. The belt conveying device as claimed in claim 1, wherein the first roller is a driven roller configured to rotate upon receipt of a force from the belt, and the second roller is a drive roller configured to apply a force to the belt to circularly move the belt.

13. An image forming apparatus comprising:

a first roller having an axis extending in an axial direction, the first roller having a first end portion on a first side in the axial direction and a second end portion on a second side opposite to the first side in the axial direction;

a second roller;

a belt configured to be looped taut around the first roller and the second roller;

an image forming unit configured to from an image on a sheet conveyed by the belt;

a rotatable assembly having a first gear and provided at the first end portion, the rotatable assembly being configured to provide a first position to engage with the first roller and to rotate upon receipt of a friction force generated between the rotatable assembly and the first roller, and a second position to be disengaged from the first roller; and a frame having a second gear arranged in a prescribed direction, the second gear engaging with the first gear.

14. The image forming apparatus as claimed in claim 13, wherein the first roller has a rotation shaft provided at the first end portion of the first roller, and wherein the rotatable assembly comprises a gripper configured to grip the rotation shaft with a gripping force variable in strength.

15. The image forming apparatus as claimed in claim 14, wherein the gripper is configured such that the gripping force increases as pressure applied to the rotatable assembly from the belt increases.

16. The image forming apparatus as claimed in claim 13, wherein the first roller comprises a roller body and a rotation shaft extending from the roller body and positioned at the first end portion of the first roller, wherein the first gear is a pinion gear having a diameter greater than a diameter of the rotation shaft and smaller than a diameter of the roller body, and wherein the second gear is a rack gear.

17. A belt conveying device comprising:

a first roller having an axis extending in an axial direction, the first roller having a first end on a first side in the axial direction and a second end on a second side opposite to the first side in the axial direction;

a second roller;

a belt configured to be looped taut around the first roller and the second roller;

a flange portion having a portion that has an outer diameter larger than that of the first roller, the flange portion being configured to be movable along with the belt in the axial direction;

a gear portion having a first gear and provided at a position next to the flange portion toward the first side; and a frame having a second gear arranged in a prescribed direction, the second gear engaging with the first gear.

18. The belt conveying device as claimed in claim 17, wherein the first roller has a rotation shaft provided at the first end of the first roller, and wherein the gear portion comprises a gripper configured to grip the rotation shaft.

19. The belt conveying device as claimed in claim 17, wherein the first roller has a rotation shaft provided at the first end of the first roller, and wherein the gear portion comprises:

a gripper configured to grip the rotation shaft; and a receiver configured to engage with the gripper and having the first gear.

20. The belt conveying device as claimed in claim 19, wherein the gripper has a portion that protrudes radially outward, and wherein the receiver has an outer wall including a notch, the portion of the gripper engaging with the notch.

* * * * *